US011168520B2

(12) United States Patent
Saylor et al.

(10) Patent No.: US 11,168,520 B2
(45) Date of Patent: Nov. 9, 2021

(54) LADDER RUNG CAP FOR USE WITH OPEN ENDED LADDER RUNGS FOR NOISE REDUCTION AND SAFETY

(71) Applicants: Geoffrey Saylor, West Chester, OH (US); Andrew Saylor, West Chester, OH (US)

(72) Inventors: Geoffrey Saylor, West Chester, OH (US); Andrew Saylor, West Chester, OH (US)

( * ) Notice: Subject to any disclaimer, the term of this patent is extended or adjusted under 35 U.S.C. 154(b) by 219 days.

(21) Appl. No.: 16/446,009

(22) Filed: Jun. 19, 2019

(65) Prior Publication Data

US 2020/0399960 A1 Dec. 24, 2020

Related U.S. Application Data

(60) Provisional application No. 62/763,616, filed on Jun. 25, 2018.

(51) Int. Cl.
*E06C 7/08* (2006.01)
*E06C 7/02* (2006.01)
*E06C 5/44* (2006.01)

(52) U.S. Cl.
CPC ..... *E06C 7/086* (2013.01); *E06C 5/44* (2013.01); *E06C 7/02* (2013.01)

(58) Field of Classification Search
CPC . E06C 7/086; E06C 7/08; E06C 7/084; E06C 7/082; E06C 7/088; E06C 5/44
See application file for complete search history.

(56) References Cited

U.S. PATENT DOCUMENTS 685,561 A * 10/1901 Bettermann ..... F16L 55/134 138/91
1,607,428 A * 11/1926 Boyd ..... F28F 11/04 138/91
2,598,278 A * 5/1952 Mason ..... F16B 9/056 182/215
2,727,672 A * 12/1955 De Luca ..... E06C 7/088 182/46
2,976,070 A * 3/1961 Gollbach ..... E05B 53/003 292/25
3,004,625 A * 10/1961 Arnold ..... E06C 7/085 182/228.6
3,142,356 A * 7/1964 Rich ..... E06C 7/088 182/194
3,578,027 A * 5/1971 Zopfi ..... F16L 55/1141 138/89

(Continued)

*Primary Examiner* — Alvin C Chin-Shue
*Assistant Examiner* — Shiref M Mekhaeil
(74) *Attorney, Agent, or Firm* — Jenei LLC

(57) ABSTRACT

A ladder rung accessory assembly includes first and second caps have a respective base that is shaped to cover respective rung openings of a selected rung of an extension ladder to reduce acoustic noise during transport. Each cap includes a guide member that is received in the respective opening to position the attached base. Channels formed through the bases and guide members are shaped to receive a cable tie passing through each cap and the selected rung. The first cap is held against the ladder by a head of the cable tie and the second cap is held against the ladder by an internal pawl locking mechanism of the second cap that ratchets against a toothed tape section of the cable tie.

8 Claims, 4 Drawing Sheets

(56) References Cited

U.S. PATENT DOCUMENTS 4,177,879 A * 12/1979 Frank ..... E06C 7/087 182/220
4,574,918 A * 3/1986 Marques ..... E06C 1/52 182/164
4,972,571 A * 11/1990 Cole ..... B21D 39/044 29/512
5,016,674 A * 5/1991 Kiss ..... F28F 11/04 138/89
5,499,737 A * 3/1996 Kraus ..... F16B 21/086 138/89
5,675,942 A * 10/1997 Crawford ..... E04F 13/0892 52/127.3
5,803,126 A * 9/1998 Zaro ..... F16L 57/005 138/89
6,032,694 A * 3/2000 Wellen ..... B65D 59/02 138/89
6,113,327 A * 9/2000 Schrader ..... B60R 9/0485 182/8
6,419,046 B1 * 7/2002 Cubbison ..... E04G 21/32 182/119
8,668,797 B2 * 3/2014 Fattori ..... B29C 65/08 156/73.1
8,776,949 B2 * 7/2014 Oswalt ..... E06C 7/00 182/129
8,807,281 B1 * 8/2014 Hoffman ..... E06C 7/143 182/129
9,010,064 B1 * 4/2015 Farahmandpour .... E04B 1/4185 52/714
9,284,202 B2 * 3/2016 Roberts ..... C02F 3/10
9,322,186 B1 * 4/2016 Chang ..... E04F 21/22
9,482,018 B2 * 11/2016 Torrents I Comas ..... E04F 21/0092
10,407,923 B2 * 9/2019 Psaila ..... E04F 21/22
10,436,111 B2 * 10/2019 Nolfi ..... F02C 7/00
10,704,275 B2 * 7/2020 Bunch ..... E04F 21/20
2002/0043036 A1 * 4/2002 Nesbitt ..... E04H 17/20 52/301
2003/0057021 A1 * 3/2003 Huber ..... E06C 5/02 182/127
2003/0127385 A1 * 7/2003 Spriegel ..... B01D 29/15 210/484
2005/0086889 A1 * 4/2005 Shock ..... E04G 23/0207 52/514
2005/0127254 A1 * 6/2005 Scott ..... E06C 7/44 248/188
2005/0194213 A1 * 9/2005 Beczak, Sr. ..... E06C 7/143 182/129
2007/0056999 A1 * 3/2007 Kahn ..... A45F 5/02 224/250
2008/0209829 A1 * 9/2008 Lucas ..... E04H 4/10 52/302.7
2010/0258376 A1 * 10/2010 Ward ..... E06C 7/00 181/175
2010/0263304 A1 * 10/2010 Torrents I Comas ..... E04F 21/0092 52/126.5
2013/0125493 A1 * 5/2013 Raheel ..... E04G 23/0207 52/514
2013/0247508 A1 * 9/2013 Hoffman ..... E04F 21/00 52/749.11
2015/0075908 A1 * 3/2015 Moss ..... E06C 1/12 182/207
2015/0211243 A1 * 7/2015 Irvine ..... E04F 21/22 52/126.1
2015/0308189 A1 * 10/2015 Valdez-Carrazco ..... E06C 7/08 182/230
2015/0376946 A1 * 12/2015 Kurzer ..... B29C 65/70 182/194
2017/0268244 A1 * 9/2017 Vicious ..... E04G 23/0211
2018/0030742 A1 * 2/2018 Lazaro Florensa ..... E04F 21/22
2018/0163468 A1 * 6/2018 Mora ..... E06C 7/083

* cited by examiner

LADDER RUNG CAP FOR USE WITH OPEN ENDED LADDER RUNGS FOR NOISE REDUCTION AND SAFETY

CLAIM OF PRIORITY UNDER 35 U.S.C. &119

The present application for patent claims priority to Provisional Application No. 62/763,616 to Saylor entitled "Ladder rung cap for use with open ended ladder rungs noise reduction and safety" filed 25 Jun. 2018, and assigned to the assignee hereof and hereby expressly incorporated by reference herein in its entirety.

BACKGROUND

1. Technical Field

The present disclosure generally relates to ladders, and more specifically to acoustic and safety treatment for ladders.

2. Description of the Related Art

During residential and commercial construction it is common to transport extension ladders on exposed racks on the tops of vehicles. Extension ladders are generally taken to and from jobsites in this manor at the beginning and end of every shift, as they are hard to store securely on job sites. The majority of extension ladders are made with open ended rungs. The rungs are generally a tube flattened on one side for the user to stand on. When viewed from the end of the tube it creates a "D" shape. These rungs extend slightly through the side rails of the extension ladder at each end of the rung and are secured in place using a rolled edge or mushroom technique. Multiple rungs are installed along the side rails at predetermined lengths. This assembly method, predominate in extension ladder manufacturing, leaves a series of "D" shaped openings running the length of the ladder side rails. When transporting an extension ladder exposed on top of a vehicle, the "D" shaped openings create a whistling noise as the air passes over them. This noise increases as the transport vehicle increases. Other shaped openings such as square or round are also known and suffer similar problems.

Generally-known approaches are generally to install trim moldings, which are all elaborate, increasing the weight of the ladder. These approaches tend to be temporary with the trim moldings falling out or peeling off. In particular, previously, stopping this noise was done in three ineffective ways. The first was by running an adhesive tape along the side rails of the extension ladder covering the "D" shaped holes. This method had many flaws i.e. poking holes in the adhesive tape or simply blowing off in the wind created by transporting the ladder on the exposed top of the vehicle. The second was spraying expanding foam in the hollow rungs. This caused a new problem, as the foam would absorb moisture exponentially increasing the weight of the already heavy ladder. The foam would also deteriorate when exposed to the sun and weather leaving a mess of foam crumble debris to be cleaned up. The third was to use a plug at the outer end of the rung, such as rubber, packing, of caulking. Here again weather was a problem. The freeze thaw cycles cause expansion and contraction causing the plug to fall out. Sometimes the plug would get pushed in and wind could blow across depressed plug causing the whistling noise to return. These plugs would also pop out during use of the extension ladder as the ladder flexed the plugs would loosen or when taking the ladder down after use it is sometimes dropped causing the plugs to pop out, especially with longer heavier ladders. Examples of such generally-known approaches include U.S. Pat. No. 8,807,281B1 which is a ladder rung plug with storage compartment and tool support. Others are U.S. Pat. No. 3,578,027A Sealing plugs or closures this is a semi-hard rubberlike plug and US20100258376A1 a sponge-like material plug and U.S. Pat. No. 8,776,949B2 is through rung style using two end caps and an elastic cord.

Consequently, a need exists for an improved modification to extension ladders to eliminate acoustic noise during transport that is economical, light-weight and reliable and preferably requires no special tooling.

BRIEF SUMMARY

In one aspect, the present disclosure provides a ladder rung accessory assembly that includes a cable tie, a first cap, and a second cap that provide an acoustic noise treatment for a ladder during transport. The cable tie includes (i) a head; and (ii) a tape section attached to the head and having teeth. The first cap includes: (i) a first base shaped to cover a first rung opening of a selected rung attached on a first lateral side rail of an extension ladder; (ii) a first guide member attached to an inner side of the first base and shaped to be received in the first rung opening to position the first base to cover the first rung opening; and (iii) a first channel formed from a distal end of the first guide member to an outer side of the first base and shaped to receive a tang end of the cable tie and shaped smaller than the head of the cable tie. The second cap includes: (i) a second base shaped to cover a second rung opening of the selected rung attached on a second lateral side rail of the extension ladder; (ii) a second guide member attached to an inner side of the second base and shaped to be received in the second rung opening to position the second base to cover the second rung opening; and (iii) a second channel formed from a distal end of the second guide member to an outer side of the second base and shaped to receive the tang end of the cable tie and comprising a pawl locking mechanisms that ratchets against the tape section of the cable tie.

In another aspect, the present disclosure provides a ladder comprising a ladder rung accessory assembly for noise treatment during transport. The ladder includes: (i) a first lateral side rail; (ii) a second lateral side rail; and (iii) more than one rung each rung attached at respective first and second openings between the first and second lateral side rails. The ladder rung accessory assembly includes a cable tie, a first cap, and a second cap that provide an acoustic noise treatment for a ladder during transport. The cable tie includes (i) a head; and (ii) a tape section attached to the head and having teeth. The first cap includes: (i) a first base shaped to cover a first rung opening of a selected rung attached on a first lateral side rail of an extension ladder; (ii) a first guide member attached to an inner side of the first base and shaped to be received in the first rung opening to position the first base to cover the first rung opening; and (iii) a first channel formed from a distal end of the first guide member to an outer side of the first base and shaped to receive a tang end of the cable tie and shaped smaller than the head of the cable tie. The second cap includes: (i) a second base shaped to cover a second rung opening of the selected rung attached on a second lateral side rail of the extension ladder; (ii) a second guide member attached to an inner side of the second base and shaped to be received in the second rung opening to position the second base to cover the second rung opening; and (iii) a second channel formed from a distal end of the second guide member to an outer side of the second base and shaped to receive the tang end of the cable tie and comprising a pawl locking mechanisms that ratchets against the tape section of the cable tie.

The above summary contains simplifications, generalizations and omissions of detail and is not intended as a comprehensive description of the claimed subject matter but, rather, is intended to provide a brief overview of some of the functionality associated therewith. Other systems, methods, functionality, features and advantages of the claimed subject matter will be or will become apparent to one with skill in the art upon examination of the following figures and detailed written description.

BRIEF DESCRIPTION OF THE DRAWINGS

The description of the illustrative embodiments can be read in conjunction with the accompanying figures. It will be appreciated that for simplicity and clarity of illustration, elements illustrated in the figures have not necessarily been drawn to scale. For example, the dimensions of some of the elements are exaggerated relative to other elements. Embodiments incorporating teachings of the present disclosure are shown and described with respect to the figures presented herein, in which.

DETAILED DESCRIPTION

Figure 1:
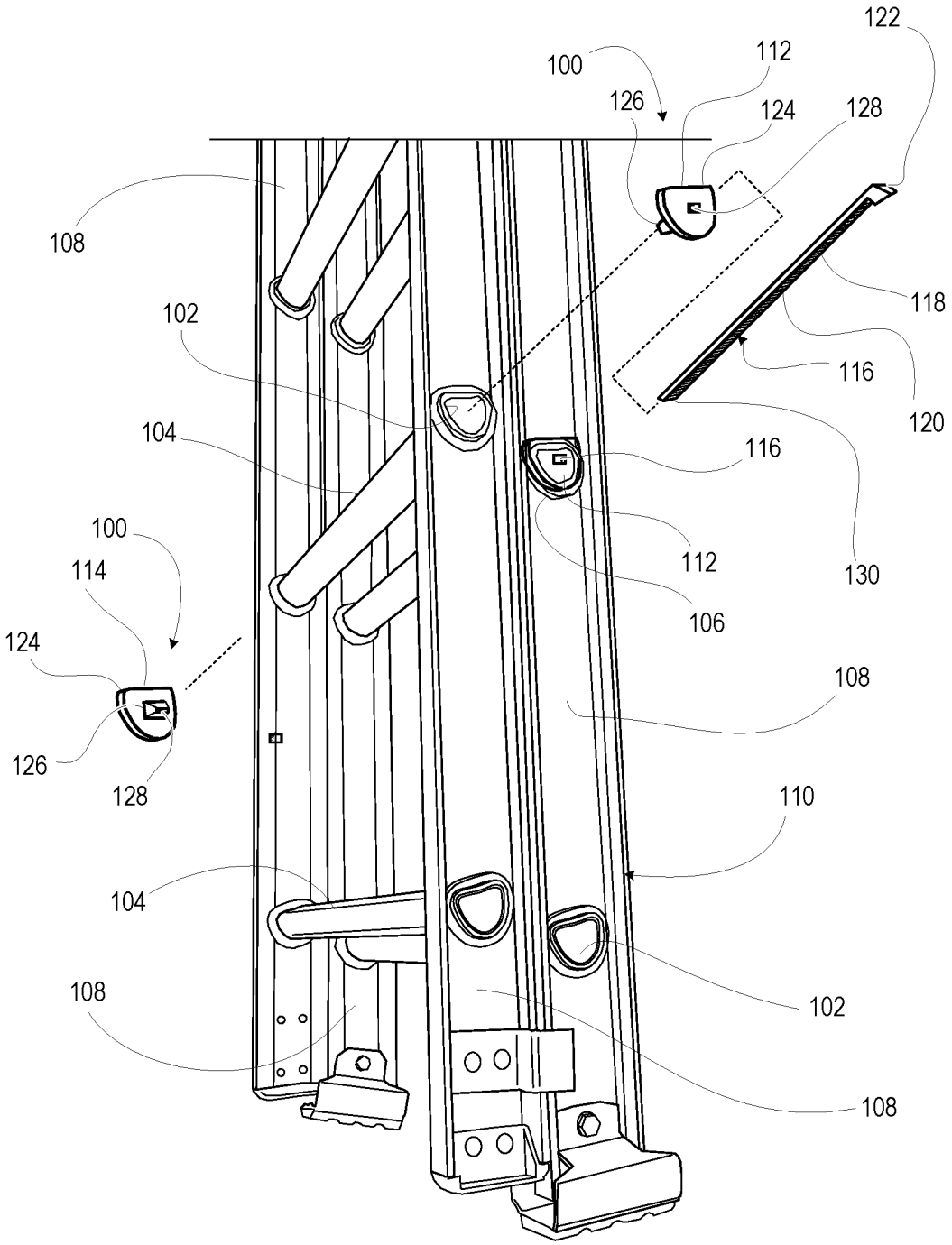
FIG. 1 is an isometric side view illustrating a ladder rung accessory assembly being mounted to an extension ladder to reduce acoustic noise during exposed transport, according to one or more embodiments.

The present innovation relates to an attachable self-supporting cap for the open ends of ladder rungs or the like for noise reduction and safety. The self-supporting cap is designed to attach thru an open ladder rung, whereas, cap "one" has a square inset with a slotted opening to accept a cable tie tang, the tang extends through the ladder rung and attaches to cap "two" with an integral cable tie locking mechanism on the opposite end of the rung.

In the following detailed description of exemplary embodiments of the disclosure, specific exemplary embodiments in which the disclosure may be practiced are described in sufficient detail to enable those skilled in the art to practice the disclosed embodiments. For example, specific details such as specific method orders, structures, elements, and connections have been presented herein. However, it is to be understood that the specific details presented need not be utilized to practice embodiments of the present disclosure. It is also to be understood that other embodiments may be utilized and that logical, architectural, programmatic, mechanical, electrical and other changes may be made without departing from general scope of the disclosure. The following detailed description is, therefore, not to be taken in a limiting sense, and the scope of the present disclosure is defined by the appended claims and equivalents thereof.

References within the specification to "one embodiment," "an embodiment," "embodiments", or "one or more embodiments" are intended to indicate that a particular feature, structure, or characteristic described in connection with the embodiment is included in at least one embodiment of the present disclosure. The appearance of such phrases in various places within the specification are not necessarily all referring to the same embodiment, nor are separate or alternative embodiments mutually exclusive of other embodiments. Further, various features are described which may be exhibited by some embodiments and not by others. Similarly, various requirements are described which may be requirements for some embodiments but not other embodiments.

Reference will now be made in detail to several embodiments of the present innovation that are illustrated in the accompanying drawings. Wherever possible, same or similar reference numerals are used in the drawings and the description to refer to the same parts or steps. The drawings are in simplified form and are not to precise scale. For purposes of convenience and clarity only, directional terms, such as, top, bottom, right side, left side and perspective may be used with respect to the drawings. These and similar direction terms should not be construed to limit the scope of the invention in any manner.

FIG. 1 depicts a ladder rung accessory assembly 100 being installed through left and right openings 102 of where each rung 104 is attached at D-shaped rolled edge 106 to side rails 108 of an extension ladder 110. The ladder rung accessory assembly 100 includes a first cap "A" 112 and a second cap "B" 114 that are held against opposing openings 102 of a selected rung 104 by a cable tie 116.

A generally-known cable tie 116, normally made of nylon, has a flexible tape section 118 with teeth 120 that engage with a pawl (not shown) in a block end or head 122 to form a ratchet. As the free end of the tape section 118 is pulled through the head 122, the cable tie 116 tightens and does not come undone. In the present disclosure, the pawl of the cable tie 116 is not used and can be omitted. In one or more embodiments, a flexible tape section can be attached to a first cap (not shown).

In one or more embodiments, the first and second caps are removable and are removably coupled by the cable tie 116 or similar ratcheting tie. The terms "removable", "removably coupled", "removably installed," "readily removable", "readily detachable", "detachably coupled", "separable," "separably coupled," and similar terms, as used in this specification and appended claims, refer to structures that can be uncoupled, detached, uninstalled, or removed from an adjoining structure with relative ease (i.e., non-destructively, and without a complicated or time-consuming process), and that can also be readily reinstalled, reattached, or coupled to the previously adjoining structure.

In one or more embodiments, the first and second caps and cable tie portions may be constructed of polymers such as nylon, polypropylene, polyester, urethane, or the like. In one or more embodiments, the first and second caps and cable tie portions may comprise a polyolefin. Typical polyolefins can include polyethylene, polypropylene, and high molecular weight polyethylene. In some embodiments, rung plugs consist essentially of a polyolefin such as polyethylene or polypropylene.

The first cap "A" 112 includes a first base 124 that is a planar substrate shaped to cover a first rung opening 102 of a selected rung 104. The first cap "A" 112 includes a first guide member 126 attached to an inner side of the first base 124. The first guide member 126 is shaped to be received in the first rung opening 102 to position the first base 124 to cover the first rung opening 102. The first cap "A" 112 includes a first channel 128 formed from a distal end of the first guide member 126 to an outer side of the first base 124. The first channel 128 is shaped to receive a tang end 130 of the cable tie 116. The first channel 128 is shaped smaller than the head 122 of the cable tie 116. The second cap "B" 114 includes a second base 134 that is a planar substrate shaped to cover a second rung opening 102 of the selected rung 104 attached on a second lateral side rail 108 of the extension ladder 110. The second cap "B" 114 includes a second guide member 136 attached to an inner side of the second base 134. The second guide member 136 is shaped to be received in the second rung opening 102 to position the second base 134 to cover the second rung opening 102. A second channel 138 is formed from a distal end of the second guide member 136 to an outer side of the second base 134. The second channel 138 is shaped to receive the tang end 130 of the cable tie 116. The second cap "B" 114 includes an internal pawl locking mechanism 140 (FIG. 6) that includes at least one primary pawl tooth that ratchets against the tape section 118 of the cable tie 116. In one or more embodiments, the internal pawl locking mechanism 140 may comprise at least one set of secondary pawl teeth.

Figure 2:
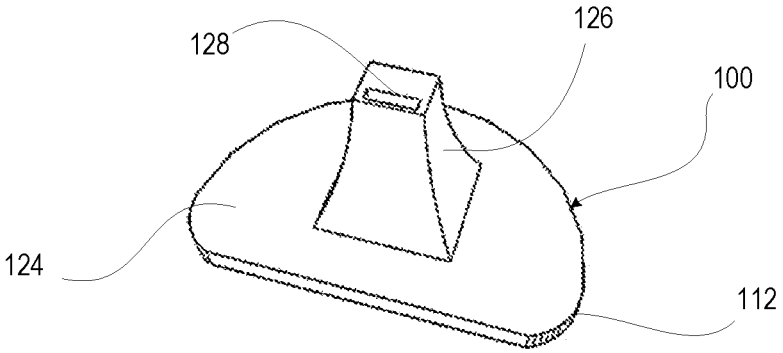
FIG. 2 is an isometric view of an inner side of the first cap "A" of the ladder rung accessory assembly, according to one or more embodiments.
Figure 3:
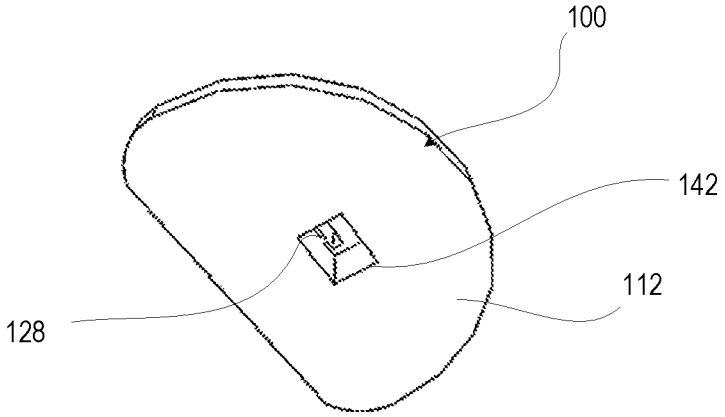
FIG. 3 is an isometric view of an outer side of the first cap "A" of the ladder rung accessory assembly, according to one or more embodiments.
Figure 4:
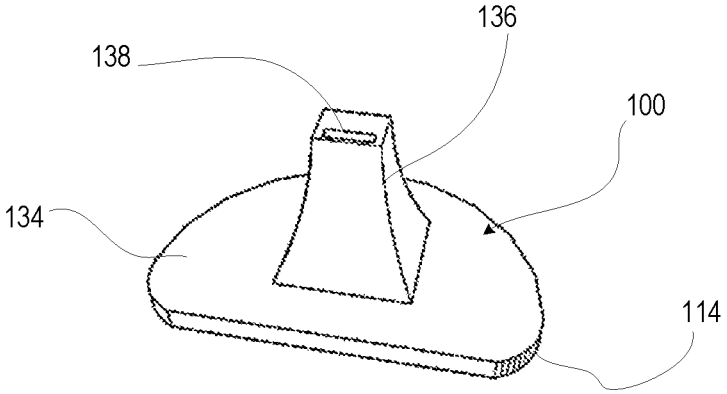
FIG. 4 is an isometric view of an inner side of the first cap "B" of the ladder rung accessory assembly, according to one or more embodiments.
Figure 5:
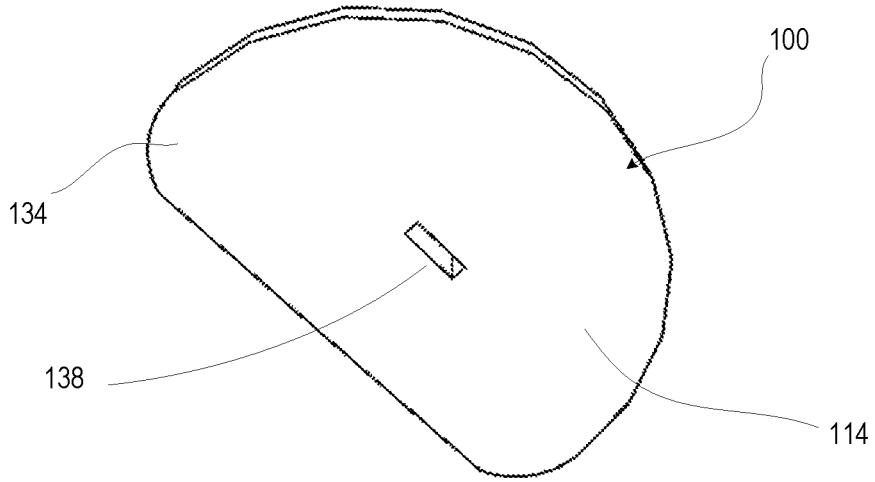
FIG. 5 is an isometric view of an outer side of the first cap "B" of the ladder rung accessory assembly, according to one or more embodiments.
Figure 6:
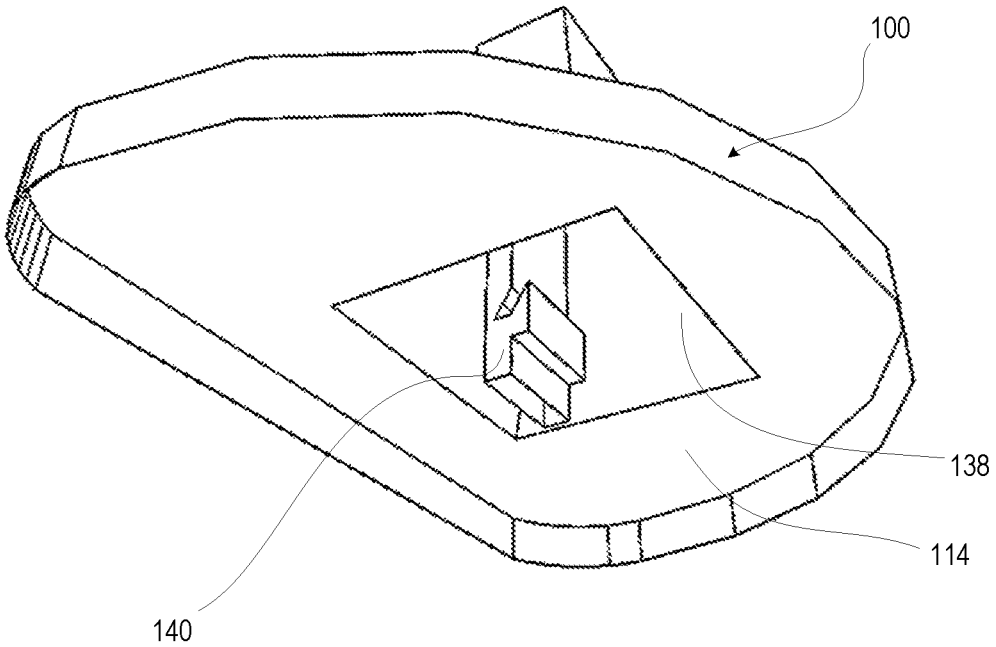
FIG. 6 is an isometric cutaway view of an outer side of the first cap "B" depicting a pawl locking mechanism that is positioned within the second channel, according to one or more embodiments.

FIG. 2 is an isometric view of an inner side of the first cap "A" 112 of the ladder rung accessory assembly 100. The first cap "A" 112 includes the first guide member 126 attached to the inner side of the first base 124 and includes the first channel 128. FIG. 3 is an isometric view of an outer side of the first cap "A" 112 of the ladder rung accessory assembly 100. A recess 142 is shaped to receive the head of the cable tie 116 (FIG. 1). The recess 142 communicates with the first channel 128. FIG. 4 is an isometric view of an inner side of the first cap "B" 114 of the ladder rung accessory assembly 100. The second cap "B" 114 includes the second base 134 that is a planar substrate attached to the second guide member 136 that includes the second channel 138. FIG. 5 is an isometric view of an outer side of the first cap "B" 114 of the ladder rung accessory assembly 100 that includes the second channel 138. FIG. 6 is an isometric cutaway view of an outer side of the first cap "B" 114 depicting the pawl locking mechanism 140 that is positioned within the second channel 138 to engage a cable tie 116 (FIG. 1).

Figure 7:
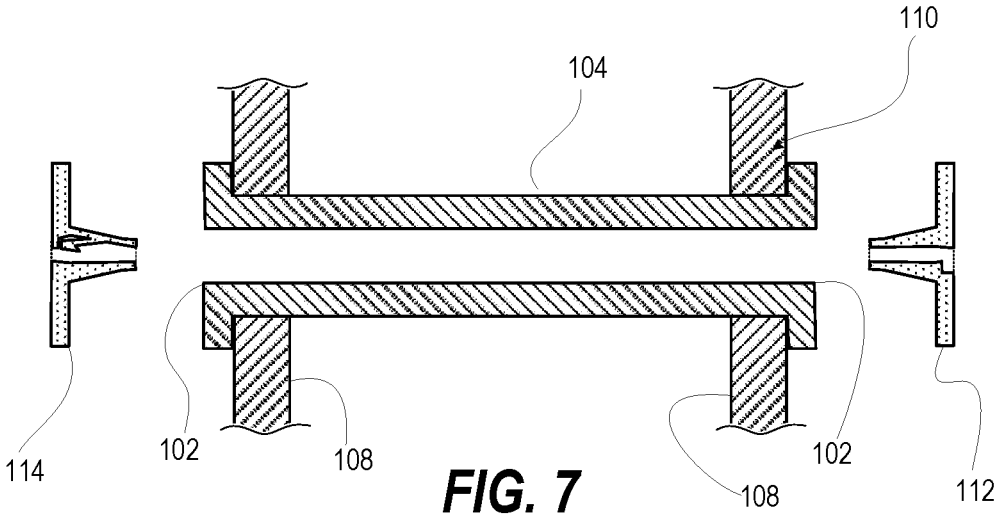
FIG. 7 depicts a simplified diagrammatic cross section view of a selected rung of an extension ladder with first and second caps positioned proximate to respective openings in side rails, according to one or more embodiments.
Figure 8:
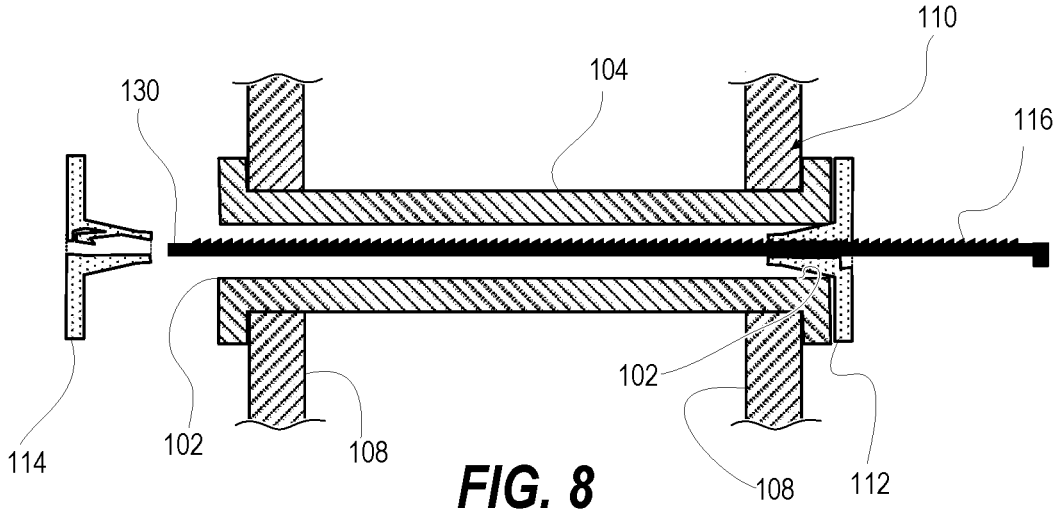
FIG. 8 depicts a simplified diagrammatic cross section view of the selected rung with the first cap "A" inserted into an opening and a cable tie inserted through the first cap "A" and the selected rung, according to one or more embodiments.
Figure 9:
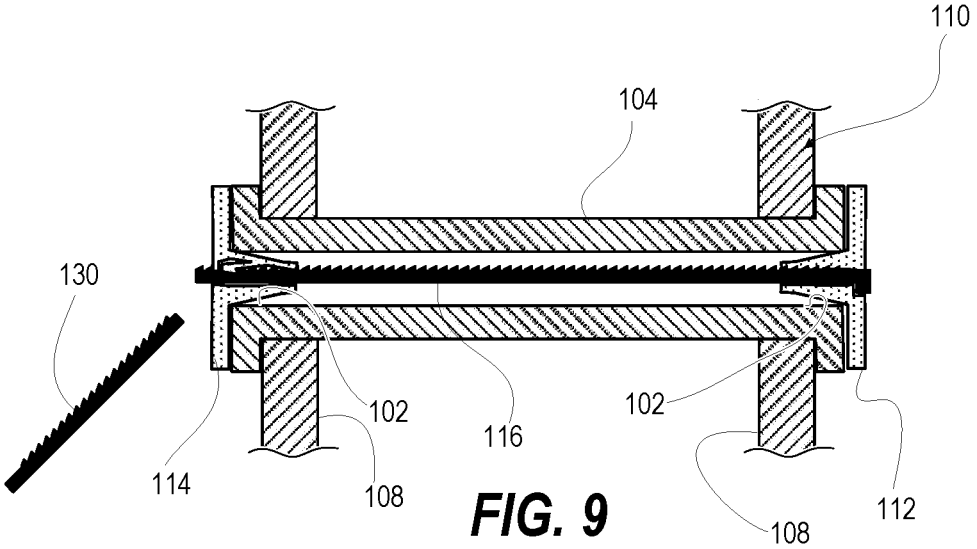
FIG. 9 depicts a simplified diagrammatic cross section view of the selected rung with the ladder rung accessory assembly installed, according to one or more embodiments.

FIG. 7 depicts a simplified diagrammatic cross section view of a selected rung 104 of an extension ladder 110. First and second caps 112, 114 are positioned proximate to respective openings 102 in side rails 108. FIG. 8 depicts a simplified diagrammatic cross section view of the selected rung 104 with the first cap "A" 112 inserted into an opening 102. A cable tie 116 is inserted through the first cap "A" 112 and the selected rung 104. The second cap 114 is aligned to receive the tang 130 of the cable tie 116. FIG. 9 depicts a simplified diagrammatic cross section view of the selected rung 104 with the second cap "B" 112 inserted into an opposing opening 102. The tang 130 and excess portion of the cable tie 116 is cut off after tightening the remaining portion of the cable tie 116 that is internal to the first and second caps 112, 114 and the selected rung 104.

While the disclosure has been described with reference to exemplary embodiments, it will be understood by those skilled in the art that various changes may be made and equivalents may be substituted for elements thereof without departing from the scope of the disclosure. In addition, many modifications may be made to adapt a particular system, device or component thereof to the teachings of the disclosure without departing from the essential scope thereof. Therefore, it is intended that the disclosure not be limited to the particular embodiments disclosed for carrying out this disclosure, but that the disclosure will include all embodiments falling within the scope of the appended claims. Moreover, the use of the terms first, second, etc. do not denote any order or importance, but rather the terms first, second, etc. are used to distinguish one element from another.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The description of the present disclosure has been presented for purposes of illustration and description, but is not intended to be exhaustive or limited to the disclosure in the form disclosed. Many modifications and variations will be apparent to those of ordinary skill in the art without departing from the scope of the disclosure. The described embodiments were chosen and described in order to best explain the principles of the disclosure and the practical application, and to enable others of ordinary skill in the art to understand the disclosure for various embodiments with various modifications as are suited to the particular use contemplated.

What is claimed is:

1. A ladder rung accessory assembly comprising:

a cable tie comprising:

a head; and a tape section attached to the head and having teeth;

a first cap comprising:

a first base shaped to cover a first rung opening of a selected rung attached on a first lateral side rail of an extension ladder and having an outer side that comprises a recess shaped to receive the head of the cable tie;

a first guide member attached to an inner side of the first base and shaped to be received in the first rung opening to position the first base to cover the first rung opening; and a first channel formed from a distal end of the first guide member to the recess of the outer side of the first base and shaped to receive a tang end of the cable tie and shaped smaller than the head of the cable tie; the recess being in communication with the first channel; and a second cap comprising:

a second base shaped to cover a second rung opening of the selected rung attached on a second lateral side rail of the extension ladder;

a second guide member attached to an inner side of the second base and shaped to be received in the second rung opening to position the second base to cover the second rung opening; and a second channel formed from a distal end of the second guide member to an outer side of the second base and shaped to receive the tang end of the cable tie and comprising a pawl locking mechanisms that ratchets against the tape section of the cable tie.

2. The ladder rung accessory assembly of claim 1, wherein the first and second bases comprise a planar substrate shaped to cover a rolled-edge attachment of a D-rung shaped rung.

3. The ladder rung accessory assembly of claim 1, wherein the first and second bases comprise a planar substrate shaped to cover a rolled-edge attachment of a rectangular shaped rung.

4. The ladder rung accessory assembly of claim 1, wherein the outer surface of the first base comprises a recess shaped to receive the head of the cable tie, the recess communicating with the first channel.

5. A ladder comprising:

a first lateral side rail;

a second lateral side rail; and more than one rung each rung attached at respective first and second openings between the first and second lateral side rails; and a ladder rung accessory assembly comprising:

a cable tie comprising:

a head; and a tape section attached to the head and having teeth;

a first cap comprising:

a first base shaped to cover a first rung opening of a selected rung attached on a first lateral side rail of an extension ladder and having an outer side that comprises a recess shaped to receive the head of the cable tie;

a first guide member attached to an inner side of the first base and shaped to be received in the first rung opening to position the first base to cover the first rung opening; and a first channel formed from a distal end of the first guide member to the recess of the outer side of the first base and shaped to receive a tang end of the cable tie and shaped smaller than the head of the cable tie; the recess being in communication with the first channel; and a second cap comprising:

a second base shaped to cover a second rung opening of the selected rung attached on a second lateral side rail of the extension ladder;

a second guide member attached to an inner side of the second base and shaped to be received in the second rung opening to position the second base to cover the second rung opening; and a second channel formed from a distal end of the second guide member to an outer side of the second base and shaped to receive the tang end of the cable tie and comprising a pawl locking mechanisms that ratchets against the tape section of the cable tie.

6. The ladder of claim 5, wherein the first and second bases comprise a planar substrate shaped to cover a rolled-edge attachment of a D-rung shaped rung.

7. The ladder of claim 5, wherein the first and second bases comprise a planar substrate shaped to cover a rolled-edge attachment of a rectangular shaped rung.

8. The ladder of claim 5, wherein the outer surface of the first base comprises a recess shaped to receive the head of the cable tie, the recess communicating with the first channel.

* * * * *